US007088053B2

(12) United States Patent
Jin et al.

(10) Patent No.: US 7,088,053 B2
(45) Date of Patent: Aug. 8, 2006

(54) DISCHARGE DISPLAY APPARATUS MINIMIZING ADDRESSING POWER AND METHOD OF DRIVING THE SAME

(75) Inventors: Kwang-Ho Jin, Cheonan-si (KR); Jin-Sung Kim, Cheonan-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 10/942,029

(22) Filed: Sep. 16, 2004

(65) Prior Publication Data

US 2005/0077836 A1 Apr. 14, 2005

(30) Foreign Application Priority Data

Oct. 14, 2003 (KR) ..... 10-2003-0071452

(51) Int. Cl.
*G09G 3/10* (2006.01)

(52) U.S. Cl. ..... 315/169.4; 315/360

(58) Field of Classification Search ..... 315/169.4, 315/360

See application file for complete search history.

(56) References Cited

U.S. PATENT DOCUMENTS

| | | | | |
|---|---|---|---|---|
| 5,541,618 | A | 7/1996 | Shinoda | |
| 5,642,018 | A * | 6/1997 | Marcotte | 315/169.4 |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,786,794 | A | 7/1998 | Kishi et al. | |
| 5,952,782 | A | 9/1999 | Nanto | |
| RE37,444 | E | 11/2001 | Kanazawa | |
| 6,476,561 | B1 * | 11/2002 | Okada | 315/169.1 |
| 6,617,788 | B1 * | 9/2003 | Shiiki et al. | 313/582 |
| 6,630,916 | B1 | 10/2003 | Shinoda | |
| 6,707,436 | B1 | 3/2004 | Setoguchi et al. | |
| 6,924,795 | B1 * | 8/2005 | Kawasaki et al. | 345/204 |
| 2001/0017606 | A1 * | 8/2001 | Choi | 345/60 |
| 2002/0047552 | A1 * | 4/2002 | Sano et al. | 315/169.2 |
| 2003/0169243 | A1 * | 9/2003 | Lee | 345/204 |
| 2005/0140586 | A1 * | 6/2005 | Choi | 345/63 |

FOREIGN PATENT DOCUMENTS

| | | |
|---|---|---|
| JP | 02-148645 | 6/1990 |
| JP | 2845183 | 10/1998 |
| JP | 2917279 | 4/1999 |
| JP | 2001-043804 | 2/2001 |
| JP | 2001-325888 | 11/2001 |
| KR | 10-2004-0002309 | 1/2004 |

OTHER PUBLICATIONS

"*Final Draft International Standard*", Project No. 47C/61988-1/Ed.1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

Korean Office Action of the Korean Patent Application No.2003-71452, mailed on Mar. 6, 2006.

* cited by examiner

*Primary Examiner*—Trinh Vo Dinh
(74) *Attorney, Agent, or Firm*—Robert E. Bushnell, Esq.

(57) ABSTRACT

A discharge display apparatus includes a discharge display panel; a controller; an address driver, which generate display data signals by processing an address signal generated by the controller and applies the display data signals to address electrode lines of the discharge display panel; and a power recovery circuit of the address driver, where operational timing of the power recovery circuit varies in response to the display data signals applied to the address electrode lines.

14 Claims, 8 Drawing Sheets

DISCHARGE DISPLAY APPARATUS MINIMIZING ADDRESSING POWER AND METHOD OF DRIVING THE SAME

CLAIM OF PRIORITY

This application makes reference to, incorporates the same herein, and claims all benefits accruing under 35 U.S.C. §119 from an application for DISCHARGE DISPLAY APPARATUS MINIMIZING ADDRESSING POWER, AND METHOD FOR DRIVING THE APPARATUS earlier filed in the Korean Intellectual Property Office on 14 Oct. 2003 and there duly assigned Serial No. 2003-71452.

BACKGROUND OF THE INVENTION

1. Field of the Invention

The present invention relates to a discharge display apparatus and a method of driving the same, and more particularly, to a discharge display apparatus having an addressing power recovery circuit and a method of driving the same.

2. Description of the Related Art

A plasma display panel (PDP) as a conventional discharge display panel includes display cells of the plasma display panel. Address electrode lines, dielectric layers, Y-electrode lines, X-electrode lines, a fluorescent layer, partition walls, and an MgO layer as a protection layer are disposed between front and rear glass substrates of a conventional surface-discharge plasma display panel (PDP).

The address electrode lines are formed at a front side of the rear glass substrate in the form of a predetermined pattern. The entire surface of the lower dielectric layer is coated in the front of the address electrode lines. The partition walls are formed at a front side of the lower dielectric layer to be parallel to the address electrode lines. The partition walls partition off a discharge area of each display cell and prevent optical cross-talk between the display cells. The fluorescent layer is formed between the partition walls.

The X-electrode lines and the Y-electrode lines are formed at a rear side of the front glass substrate in the form of a predetermined pattern to be orthogonal to the address electrode lines. A corresponding display cell is formed at cross points of the X-electrode lines and the Y-electrode lines. Each of the X-electrode lines and each of the Y-electrode lines are formed in such a manner that transparent electrode lines formed of a transparent conductive material such as indium tin oxide (ITO) and metallic electrode lines used in improving conductivity are combined with one another. The front dielectric layer is formed in such a manner that the entire surface of the front dielectric layer is coated at rear sides of the X-electrode lines and the Y-electrode lines. The protective layer for protecting the PDP from a strong electric field, for example, an MgO layer is formed in such a manner that the entire surface of the MgO layer is coated at a rear side of the upper dielectric layer. A gas used in forming plasma is sealed in a discharge space.

In a method of driving the conventional PDP, initialization, addressing, and display sustain steps are sequentially performed in a unit sub-field is generally applied to the conventional PDP. In an initialization step, a charge state of display cells to be driven is uniform. In an addressing step, a charge state of display cells to be turned on and a charge state of display cells to be turned off are set. In a display sustain step, display cells to be turned on perform display discharge.

In this case, a plurality of unit sub-fields are included in a unit frame so that a desired gray scale can be displayed in display periods of each sub-field.

A unit frame is divided into eight sub-fields, so as to display a time division gray scale. In addition, each of sub-fields is divided into address fields, and display sustain periods.

In each of the address periods, display data signals having a high level are applied to the address electrode lines, and simultaneously, scan pulses each corresponding to Y-electrode lines are subsequently applied to the address electrode lines. As a result, wall charges are formed by address discharge in a corresponding discharge cell to which the display data signals having a high level are applied, and wall charges are not formed in a discharge cell to which the display data signals having a high level are not applied.

In each of the display sustain periods, display discharge pulses are alternately applied to all the Y-electrode lines and all X-electrode lines so that display discharge occurs in discharge cells in which the wall charges are formed in the corresponding address periods. As such, the brightness of the PDP is proportional to the length of the display sustain periods occupied by the unit frame. The length of the display sustain periods occupied by the unit frame is 255 T (T is a unit time). Thus, the brightness of the PDP may be represented as a 256 gray scale including a case where the brightness has been never displayed in the unit frame.

As a result, by properly selecting a sub-field to be displayed from the eight sub-fields, all 256 gray scales including a zero gray scale that is not displayed at any sub-field may be displayed.

In the address-display separation driving method, since time areas of each of the sub-fields are separated from one another in a unit frame, time areas of address periods and display periods are separated from one another at each of the sub-fields. Thus, it should be waited until another X- and Y-electrode line pairs are addressed after each of X- and Y-electrode line pairs is addressed in the address periods. As such, a time taken for the address periods with respect to each sub-field becomes long and the display periods become short, causing degradation of the brightness of light emitted from a PDP. In order to solve this problem, an address-while-display driving method is well known.

In a conventional address-while-display separation driving method with respect to Y-electrode lines of the PDP, a unit frame is divided into eight sub-fields, so as to display a time division gray scale. In this case, each unit sub-field overlaps based on driven Y-electrode lines and composes a unit frame. Thus, since there are all sub-fields at all time points, an address time slot is set between display discharge pulses, so as to perform each addressing step.

Reset, addressing, and display sustain steps are performed at each sub-field, and a time taken for each sub-field is determined by a display discharge time corresponding to a gray scale. For example, when a 256 gray scale is displayed in units of frames as 8-bit image data and the unit frame (generally, 1/60 second) is comprised of a 255 unit time, a first sub-field driven according to image data of least significant bit (LSB) has a unit time $1(2^0)$, a second sub-field has a unit time $2(2^1)$, a third sub-field has a unit time $4(2^2)$, a fourth sub-field has a unit time $8(2^3)$, a fifth sub-field has a unit time $16(2^4)$, a sixth sub-field has a unit time $32(2^5)$, a seventh sub-field has a unit time $64(2^6)$, and an eighth sub-field driven according to image data of the most significant bit (MSB) has a unit time $128(2^7)$. That is, since the sum of unit times allocated to each of the sub-fields is a 255 unit time, a 255 gray scale can be displayed, and a 256 gray scale can be displayed including a case where a gray scale that is not display-discharged at any sub-field.

In the conventional discharge display apparatus, a power recovery circuit which recovers driving power of address electrode lines, is provided in each address period. The operational timing of the power recovery circuit is set to be constant. However, the number of display cells to be turned on in each scan time varies, and thus, the capacitance of a discharge display panel varies. As a result, the operational timing of the power recovery circuit is improper for a capacitance of the discharge display panel so that the waveform of an addressing voltage is distorted and consumed power increases.

SUMMARY OF THE INVENTION

It is therefore and objective of present invention to provide a discharge display apparatus which improves the operation of a circuit for recovering addressing power to decrease consumed power without distortion of the waveform of an addressing voltage, and a method of driving the discharge display apparatus.

It is another object to provide in the discharge display apparatus and the method of driving the same according to the present invention, the operational timing of a power recovery circuit varying in response to display data signals applied to address electrode lines, and as a result, the operational timing of the power recovery circuit becomes proper for a variable capacitance of a discharge display panel so that the waveform of an addressing voltage is not distorted and consumed power decreases.

It is yet another object of the present invention to provide a discharge display apparatus and method that is easy to implement, cost effective, reliable and efficient.

According to an aspect of the present invention, there is provided a discharge display apparatus, the discharge display apparatus including a discharge display panel; a controller; an address driver, which generate display data signals by processing an address signal generated by the controller and applies the display data signals to address electrode lines of the discharge display panel; and a power recovery circuit of the address driver, wherein operational timing of the power recovery circuit varies in response to the display data signals applied to the address electrode lines.

According to another aspect of the present invention, there is provided a method of driving a discharge display apparatus, the discharge display apparatus including a discharge display panel; a controller; an address driver, which generate display data signals by processing an address signal generated by the controller and applies the display data signals to address electrode lines of the discharge display panel; and a power recovery circuit of the address driver, wherein operational timing of the power recovery circuit varies in response to the display data signals applied to the address electrode lines.

According to the discharge display apparatus and the method of driving the same, the operational timing of the power recovery circuit varies in response to display data signals applied to the address electrode lines. As such, the operational timing of the power recovery circuit becomes proper for variable capacitance of the discharge display panel such that the waveform of the addressing voltage is not distorted and consumed power decreases.

The present invention can also be realized as computer-executable instructions in computer-readable media.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
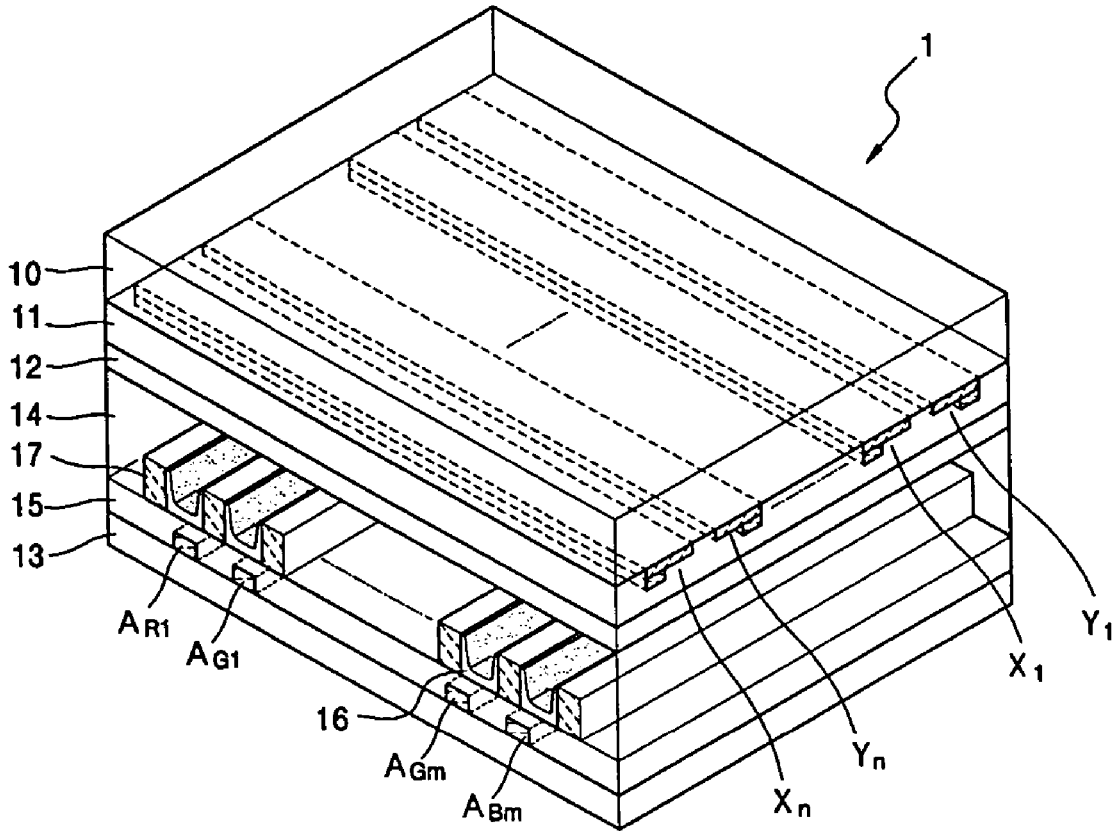
FIG. 1 is an internal perspective view showing a structure of a plasma display panel (PDP) as a conventional discharge display panel.
Figure 2:
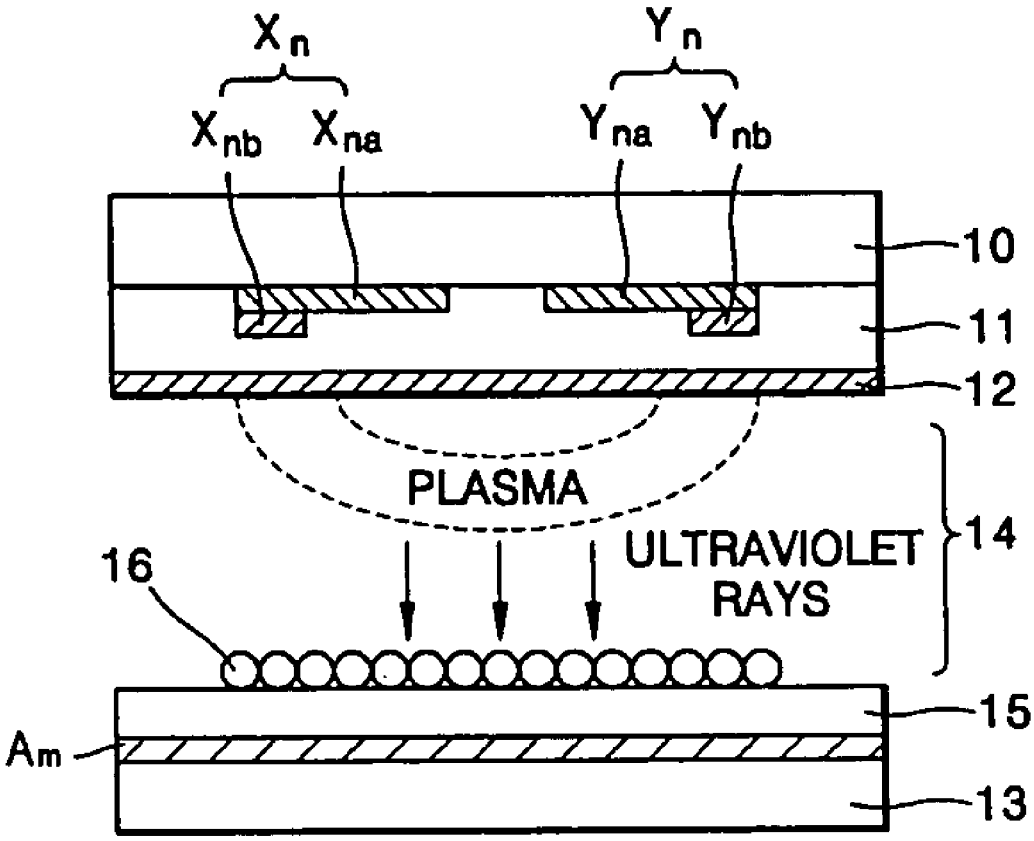
FIG. 2 is a cross-sectional view showing an example of a display cell of the plasma display panel of FIG. 1.

Turning now to the drawings, FIG. 1 shows the structure of a plasma display panel (PDP) as a conventional discharge display panel. FIG. 2 shows an example of a display cell of the plasma display panel of FIG. 1. Referring to FIGS. 1 and 2, address electrode lines $A_{R1}$, $A_{G1}$, . . . , $A_{Gm}$, and $A_{Bm}$, dielectric layers 11 and 15, Y-electrode lines $Y_1$, . . . , and Yn, X-electrode lines $X_1$, . . . , and $X_n$, a fluorescent layer 16, partition walls 17, and an MgO layer 12 as a protection layer are disposed between front and rear glass substrates 10 and 13 of a conventional surface-discharge plasma display panel (PDP) 1.

The address electrode lines $A_{R1}$, $A_{G1}$, . . . , $A_{Gm}$, and $A_{Bm}$ are formed at a front side of the rear glass substrate 13 in the form of a predetermined pattern. The entire surface of the lower dielectric layer 15 is coated in the front of the address electrode lines $A_{R1}$, $A_{G1}$, . . . , $A_{Gm}$, and $A_{Bm}$. The partition walls 17 are formed at a front side of the lower dielectric layer 15 to be parallel to the address electrode lines $A_{R1}$, $A_{G1}$, . . . , $A_{Gm}$, and $A_{Bm}$. The partition walls 17 partition off a discharge area of each display cell and prevent optical cross-talk between the display cells. The fluorescent layer 16 is formed between the partition walls 17.

The X-electrode lines $X_1$, . . . , and $X_n$ and the Y-electrode lines $Y_1$, . . . , and $Y_n$ are formed at a rear side of the front glass substrate 10 in the form of a predetermined pattern to be orthogonal to the address electrode lines $A_{R1}$, $A_{G1}$, . . . , $A_{Gm}$, and $A_{Bm}$. A corresponding display cell is formed at cross points of the X-electrode lines $X_1$, . . . , and $X_n$ and the Y-electrode lines $Y_1$, . . . , and $Y_n$. Each of the X-electrode lines $X_1$, . . . , and $X_n$ and each of the Y-electrode lines $Y_1$, . . . , and $Y_n$ are formed in such a manner that transparent electrode lines ($X_{na}$ and $Y_{na}$ of FIG. 2) formed of a transparent conductive material such as indium tin oxide (ITO) and metallic electrode lines ($X_{nb}$ and $Y_{nb}$ of FIG. 2) used in improving conductivity are combined with one another. The front dielectric layer 11 is formed in such a manner that the entire surface of the front dielectric layer 11 is coated at rear sides of the X-electrode lines $X_1$, . . . , and $X_n$ and the Y-electrode lines $Y_1$, . . . , and $Y_n$. The protective layer 12 for protecting the PDP 1 from a strong electric field, for example, an MgO layer is formed in such a manner that the entire surface of the MgO layer 12 is coated at a rear side of the upper dielectric layer 11. A gas used in forming plasma is sealed in a discharge space 14.

In a method of driving the conventional PDP, initialization, addressing, and display sustain steps are sequentially performed in a unit sub-field is generally applied to the conventional PDP. In an initialization step, a charge state of display cells to be driven is uniform. In an addressing step, a charge state of display cells to be turned on and a charge state of display cells to be turned off are set. In a display sustain step, display cells to be turned on perform display discharge.

In this case, a plurality of unit sub-fields are included in a unit frame so that a desired gray scale can be displayed in display periods of each sub-field.

Figure 3:
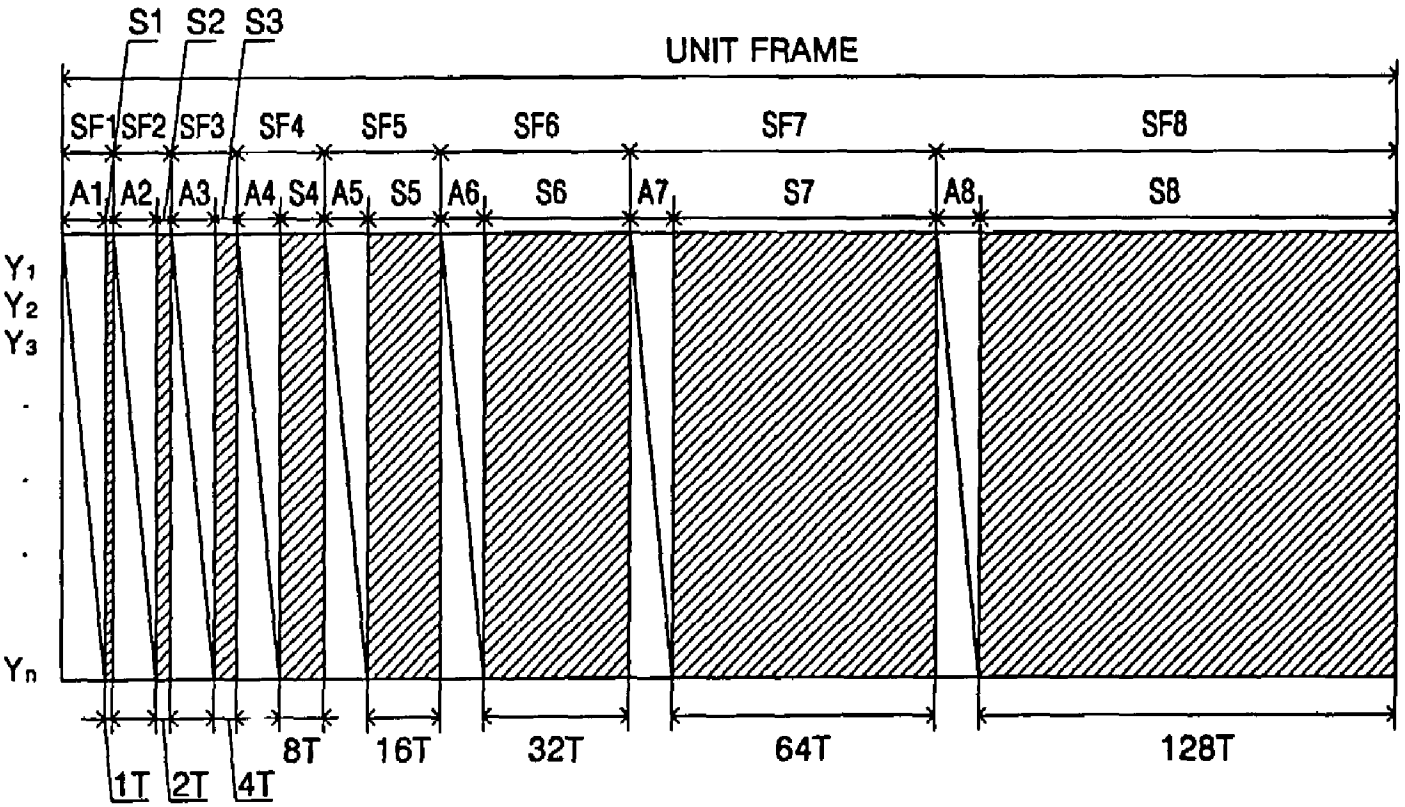
FIG. 3 is a timing diagram showing a conventional address-display separation driving method with respect to Y-electrode lines of the PDP of FIG. 1.

FIG. 3 shows a conventional address-display separation driving method with respect to Y-electrode lines of the PDP of FIG. 1. Referring to FIG. 3, a unit frame is divided into eight sub-fields SF1, . . . , and SF8, so as to display a time division gray scale. In addition, each of sub-fields SF1, . . . , and SF8 is divided into address fields A1, . . . , and A8, and display sustain periods S1, . . . , and S8.

In each of the address periods A1, . . . , and A8, display data signals having a high level are applied to the address electrode lines ($A_{R1}$, $A_{G1}$, . . . , $A_{Gm}$, and $A_{Bm}$ of FIG. 1), and simultaneously, scan pulses each corresponding to Y-electrode lines Y, . . . , and $Y_n$ are subsequently applied to the address electrode lines ($A_{R1}$, $A_{G1}$, . . . , $A_{Gm}$, and $A_{Bm}$ of FIG. 1). As a result, wall charges are formed by address discharge in a corresponding discharge cell to which the display data signals having a high level are applied, and wall charges are not formed in a discharge cell to which the display data signals having a high level are not applied.

In each of the display sustain periods S1, . . . , and S8, display discharge pulses are alternately applied to all the Y-electrode lines $Y_1$, . . . , and $Y_n$ and all X-electrode lines $X_1$, . . . , and $X_n$ so that display discharge occurs in discharge cells in which the wall charges are formed in the corresponding address periods A1, . . . , and A8. As such, the brightness of the PDP is proportional to the length of the display sustain periods S1, . . . , and S8 occupied by the unit frame. The length of the display sustain periods S1, . . . , and S8 occupied by the unit frame is 255 T (T is a unit time). Thus, the brightness of the PDP may be represented as a 256 gray scale including a case where the brightness has been never displayed in the unit frame.

In this case, in the display sustain period S1 of the first sub-field SF1, a time 1 T corresponding to $2^0$ is set, in the display sustain period S2 of the second sub-field SF2, a time 2 T corresponding to $2^1$ is set, in the display sustain period S3 of the third sub-field SF3, a time 4 T corresponding to $2^2$ is set, in the display sustain period S4 of the fourth sub-field SF4, a time 8 T corresponding to $2^3$ is set, in the display sustain period S5 of the fifth sub-field SF5, a time 16 T corresponding to $2^4$ is set, in the display sustain period S6 of the sixth sub-field SF6, a time 32 T corresponding to $2^5$ is set, in the display sustain period S7 of the seventh sub-field SF7, a time 64 T corresponding to $2^6$ is set, and in the display sustain period S8 of the eighth sub-field SF8, a time 128 T corresponding to $2^7$ is set.

As a result, by properly selecting a sub-field to be displayed from the eight sub-fields, all 256 gray scales including a zero gray scale that is not displayed at any sub-field may be displayed.

In the address-display separation driving method, since time areas of each of the sub-fields SF1, . . . , and SF8 are separated from one another in a unit frame, time areas of address periods and display periods are separated from one another at each of the sub-fields SF1, . . . , and SF8. Thus, it should be waited until another X- and Y-electrode line pairs are addressed after each of X- and Y-electrode line pairs is addressed in the address periods. As such, a time taken for the address periods with respect to each sub-field becomes long and the display periods become short, causing degradation of the brightness of light emitted from a PDP. In order to solve this problem, an address-while-display driving method shown in FIG. 4 is well known.

Figure 4:
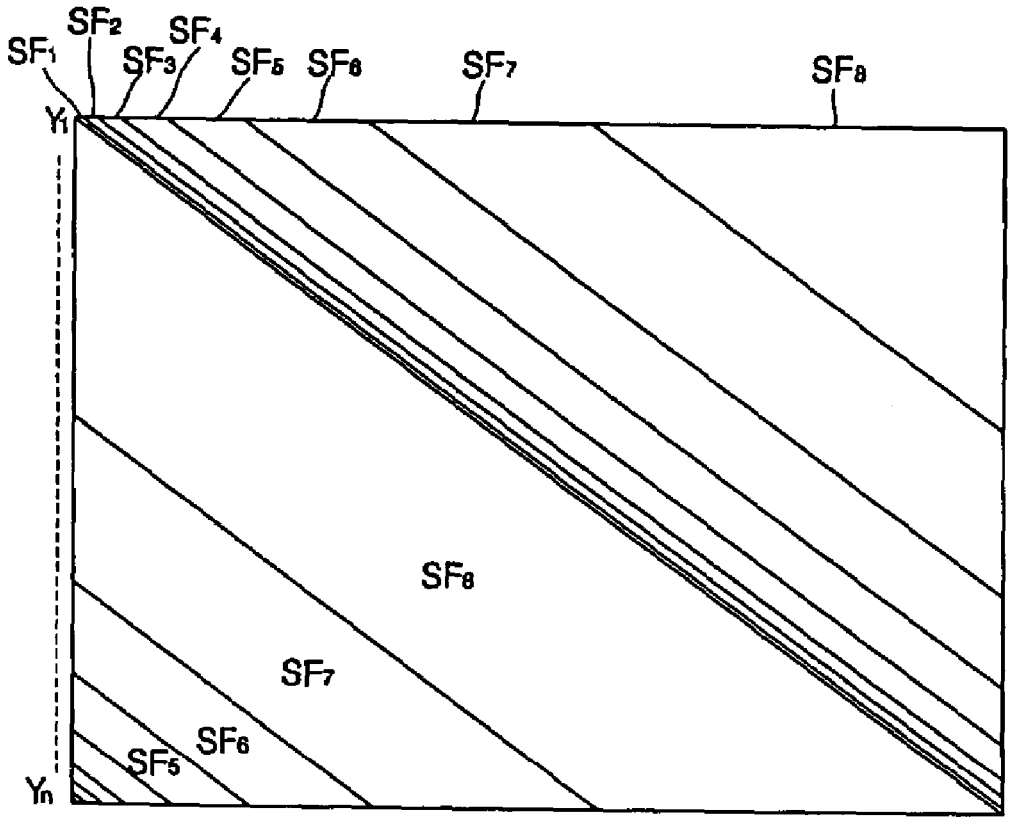
FIG. 4 is a timing diagram showing a conventional address-while-display separation driving method with respect to Y-electrode lines of the PDP of FIG. 1.

FIG. 4 shows a conventional address-while-display separation driving method with respect to Y-electrode lines of the PDP of FIG. 1. Referring to FIG. 4, a unit frame is divided into eight sub-fields $SF_1$, . . . , and $SF_8$, so as to display a time division gray scale. In this case, each unit sub-field overlaps based on driven Y-electrode lines $Y_1$, . . . , and $Y_n$ and composes a unit frame. Thus, since there are all sub-fields $SF_1$, . . . , and $SF_8$ at all time points, an address time slot is set between display discharge pulses, so as to perform each addressing step.

Reset, addressing, and display sustain steps are performed at each sub-field, and a time taken for each sub-field is determined by a display discharge time corresponding to a gray scale. For example, when a 256 gray scale is displayed in units of frames as 8-bit image data and the unit frame (generally, 1/60 second) is comprised of a 255 unit time, a first sub-field $SF_1$ driven according to image data of least significant bit (LSB) has a unit time $1(2^0)$, a second sub-field $S_{F2}$ has a unit time $2(2^1)$, a third sub-field $SF_3$ has a unit time $4(2^2)$, a fourth sub-field $SF_4$ has a unit time $8(2^3)$, a fifth sub-field $SF_5$ has a unit time $16(2^4)$, a sixth sub-field $SF_6$ has a unit time $32(2^5)$, a seventh sub-field $SF_7$ has a unit time $64(2^6)$, and an eighth sub-field $SF_8$ driven according to image data of the most significant bit (MSB) has a unit time $128(2^7)$. That is, since the sum of unit times allocated to each of the sub-fields is a 255 unit time, a 255 gray scale can be displayed, and a 256 gray scale can be displayed including a case where a gray scale that is not display-discharged at any sub-field.

In the conventional discharge display apparatus, a power recovery circuit which recovers driving power of address electrode lines ($A_{R1}$, $A_{G1}$, . . . , $A_{Gm}$, and $A_{Bm}$ of FIG. 1), is provided in each address period (A1, . . . , and A8 of FIG. 3). The operational timing of the power recovery circuit is set to be constant. However, the number of display cells to be turned on in each scan time varies, and thus, the capacitance of a discharge display panel (1 of FIG. 1) varies. As a result, the operational timing of the power recovery circuit is improper for a capacitance of the discharge display panel 1 so that the waveform of an addressing voltage is distorted and consumed power increases.

Referring to FIGS. 1 through 5, a discharge display apparatus includes a plasma display panel (PDP) 1, an image processor 66, a controller 62, an address driver apparatus 63, an X-driver 64, and a Y-driver 65. The image processor 66 converts an external analog image signal into a digital signal and generates internal image signals, for example, 8-bit red (R), green (G), and blue (B) image data, a clock signal, and vertical and horizontal synchronous signals. The controller 62 generates driving control signals $S_A$, $S_Y$, and $S_X$ in response to the internal image signals generated by the image processor 66. The address driver apparatus 63 generates display data signals by processing the address signal $S_A$ from the driving control signals $S_A$, $S_Y$, and $S_X$ generated by the controller 62 and applies the display data signals to address electrode lines ($A_{R1}$, $A_{G1}$, . . . , $A_{Gm}$, and $A_{Bm}$ of FIG. 1). The X-driver 64 processes the X-driving control signal $S_X$ from the driving control signals $S_A$, $S_Y$, and $S_X$ generated by the controller 62 and applies the X-driving control signal $S_X$ to X-electrode lines. The Y-driver 65 processes the Y-driving control signal $S_Y$ from the driving control signals $S_A$, $S_Y$, and $S_X$ generated by the controller 62 and applies the Y-driving control signal $S_Y$ to Y-electrode lines.

The address driver apparatus 63 includes a power recovery circuit which recovers driving power of address electrode lines ($A_{R1}$, $A_{G1}$, . . . , $A_{Gm}$, and $A_{Bm}$ of FIG. 1) in each address period (A1, . . . , and A8 of FIG. 3). The operational timing of the power recovery circuit varies in response to the display data signals applied to the address electrode lines $A_{R1}$, $A_{G1}$, . . . , $A_{Gm}$, and $A_{Bm}$. As such, the operational timing of the power recovery circuit becomes proper for a variable capacitance of the plasma display panel (PDP) 1 so that consumed power can decrease without distortion of the waveform of an address voltage.

Figure 5:
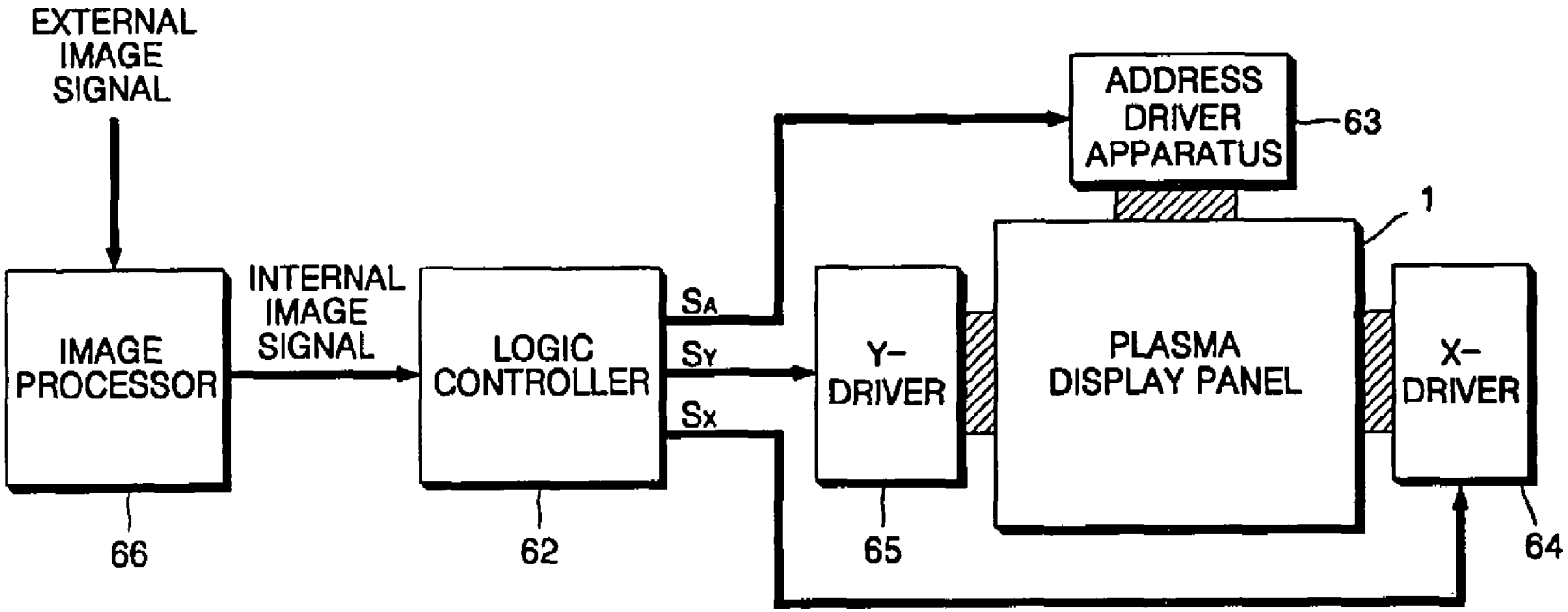
FIG. 5 is a block diagram showing a structure of a plasma display apparatus as a discharge display apparatus according to an embodiment of the present invention.
Figure 6:
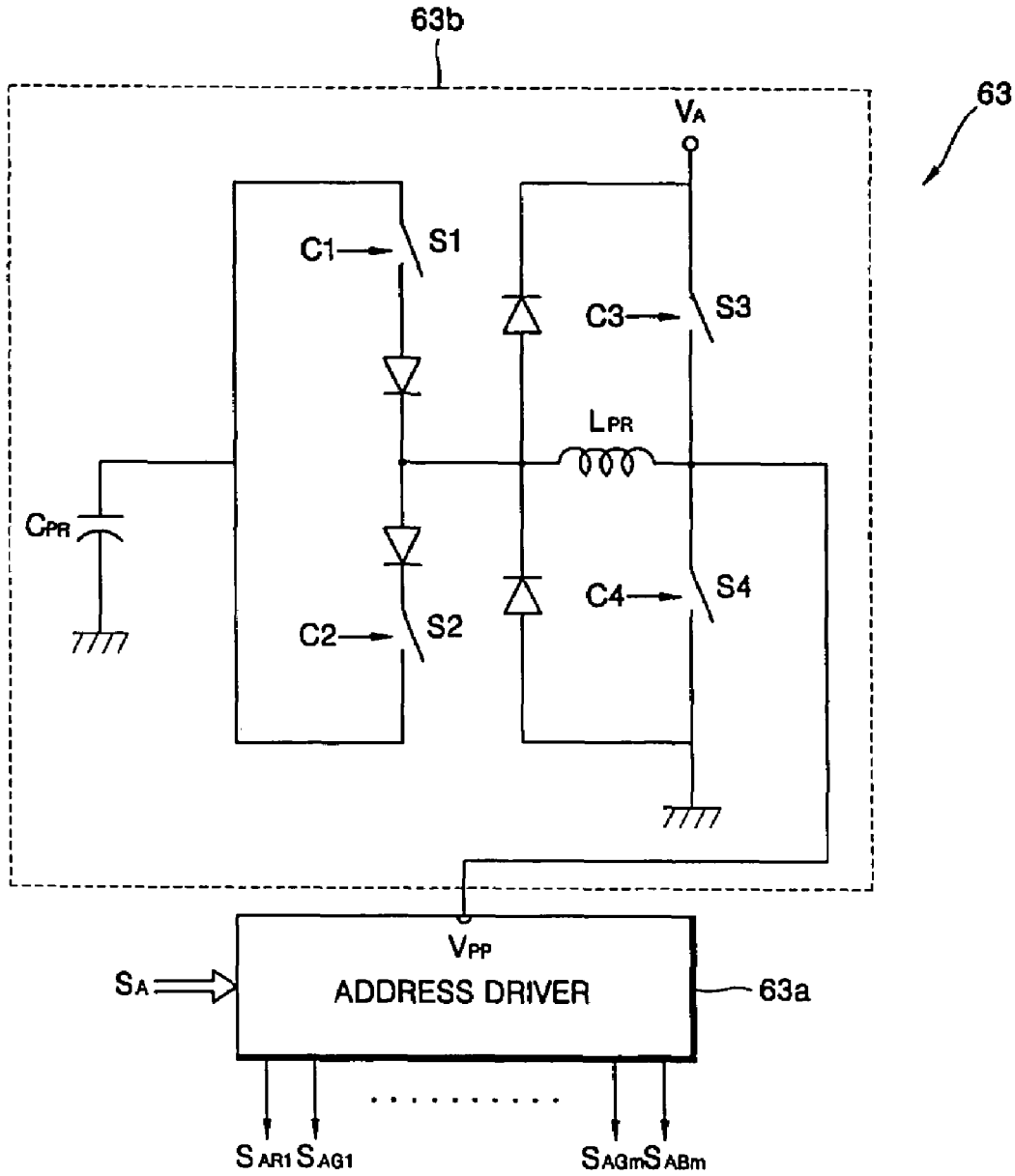
FIG. 6 shows a power recovery circuit of an address driver of the discharge display of FIG. 5.

FIG. 6 shows a power recovery circuit of the address driver apparatus 63 of the discharge display apparatus of FIG. 5. Referring to FIGS. 1, 5, and 6, the address driver apparatus 63 generates display data signals $S_{AR1}$, $S_{AG1}$, . . . , $S_{AGm}$, and $S_{ABm}$ by processing the address signal $S_A$ from the driving control signals $S_A$, $S_Y$, and $S_X$ generated by the controller 62 and applies the display data signals to address electrode lines $A_{R1}$, $A_{G1}$, . . . , $A_{Gm}$, and $A_{Bm}$. A supply voltage VA, that is, an addressing voltage of the address driver 63*a* is controlled by operating a power recovery circuit 63*b* so that charges remaining in display cells of the PDP 1 are collected at a time when applying of the display data signals $S_{AR1}$, $S_{AG1}$, . . . , $S_{AGm}$, and $S_{ABm}$ is complete and the collected charges are applied to the display cells at a time when applying of the display data signals $S_{AR1}$, $S_{AG1}$, . . . , $S_{AGm}$, and $S_{ABm}$ starts. Inductance of a resonance coil $L_{PR}$ of the power recovery circuit 63*b* is set so that resonance can be performed on an average operational capacitance of the PDP 1.

The operational timing of the power recovery circuit 63*b* varies in response to the display data signals applied to the address electrode lines $A_{R1}$, $A_{G1}$, . . . , $A_{Gm}$, and $A_{Bm}$. In other words, the operational timing of the power recovery circuit 63*b* varies according to the number of display cells to be turned on in each scan period. As such, the operational timing of the power recovery circuit 63*b* becomes proper for a variable capacitance of the plasma display panel (PDP) 1 so that consumed power can decrease without distortion of the waveform of an address voltage.

Figure 7:
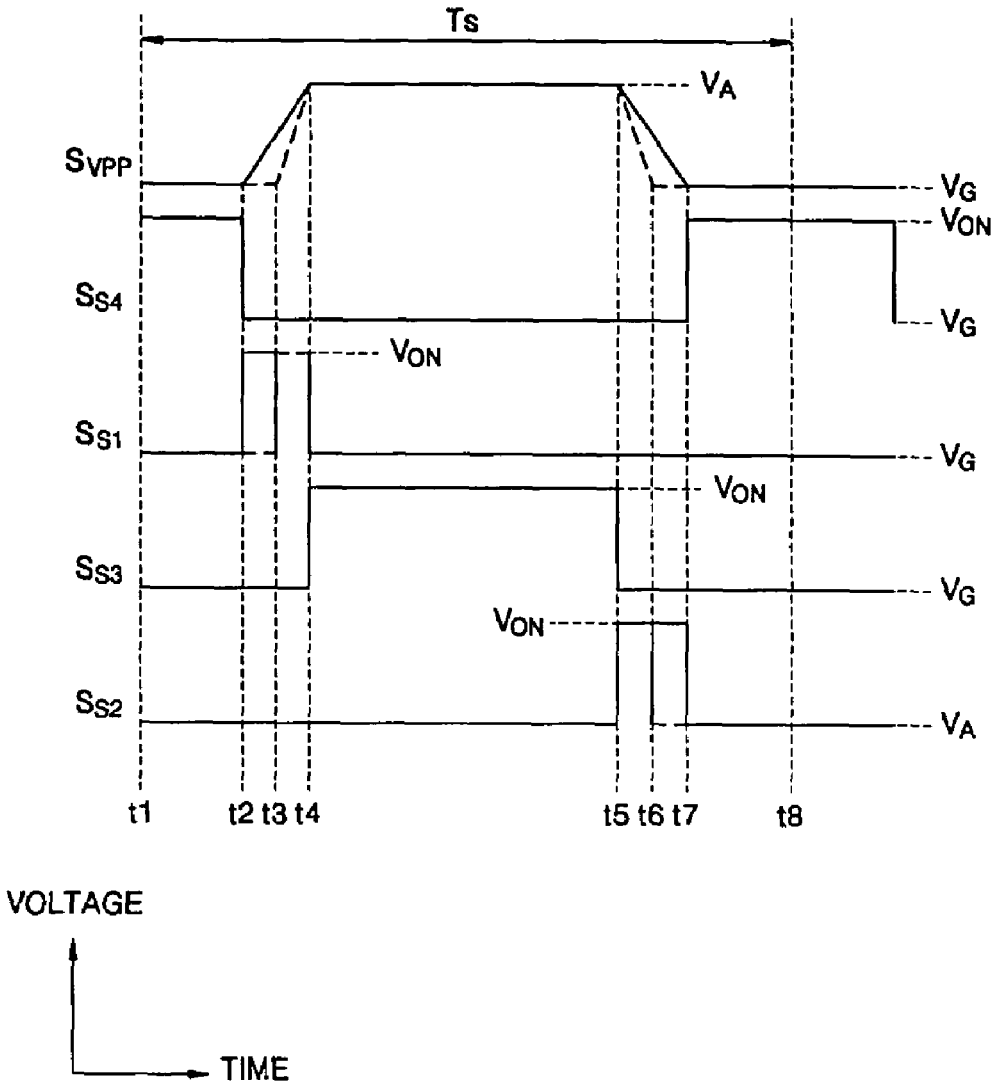
FIG. 7 shows the operational timing of the power recovery circuit of FIG. 6.

FIG. 7 shows the operational timing of the power recovery circuit 63*b* of FIG. 6. In FIG. 7, $S_{VPP}$ is a supply voltage signal applied to a supply voltage applying terminal ($V_{pp}$ of FIG. 6) of an address driver (63*a* of FIG. 6), $S_{S1}$ is a control signal of a first switch (S1 of FIG. 6), $S_{S2}$ is a control signal of a second switch (S2 of FIG. 6), $S_{S3}$ is a control signal of a third switch (S3 of FIG. 6), and $S_{S4}$ is a control signal of a fourth switch (S4 of FIG. 6). In addition, $T_S$ is a unit scan time, $V_G$ is a ground voltage, and $V_{ON}$ is a control voltage for turning on of each switch (S1 through S4).

The operation of the power recovery circuit 63*b* at the unit scan time $T_S$ of an address period (A1 through A8 of FIG. 3) will now be described with reference to FIGS. 6 and 7.

At a time t5 when applying of the display data signals $S_{AR1}$, $S_{AG1}$, . . . , $S_{AGm}$, and $S_{ABm}$ is complete, only the second switch S2 is turned on so that charges remaining in display cells of the PDP 1 are collected in a charge and discharge capacitor CPR using the supply voltage applying terminal $V_{pp}$, the resonance coil $L_{PR}$, and the second switch S2 of the address driver 63*a*.

Next, only the fourth switch S4 is turned on so that the supply voltage VA applied to the address driver 63 is a ground voltage.

In this case, a time when only the fourth switch S4 is turned on is determined by a time when the second switch S2 is turned off. The time when the second switch S2 is turned off is determined in response to the display data signals $S_{AR1}$, $S_{AG1}$, . . . , $S_{AGm}$, and $S_{ABm}$ between t6 and t7. More specifically, the time when the second switch S2 is turned off is delayed proportional to the number of the display cells to be turned on and the number of the display cells to be turned on is proportional to the capacitance of the PDP 1 at the unit scan time $T_S$. In other words, a time when the charges remaining in the display cells are collected varies proportional to the number of the display cells to be turned on and the number of the display cells to be turned on is proportional to the capacitance of the PDP 1 at the unit scan time $T_S$.

Next, at a time t2 when applying of the display data signals $S_{AR1}$, $S_{AG1}$, . . . , $S_{AGm}$, and $S_{ABm}$ starts, only the first switch S1 is turned on so that charges collected in the charge and discharge capacitor CPR are applied to the display cells of the PDP 1 using the first switch S1, the resonance coil $L_{PR}$, and the supply voltage applying terminal $V_{pp}$ of the address driver 63*a*.

Next, only the third switch S3 is turned on so that the supply voltage VA is applied to the address driver 63*a*, and applying of the display data signals $S_{AR1}$, $S_{AG1}$, . . . , $S_{AGm}$, and $S_{ABm}$ is performed.

In this case, a time when only the third switch S3 is turned on is determined by a time when the first switch S1 is turned off. The time when the first switch S1 is turned off is determined in response to the display data signals $S_{AR1}$, $S_{AG1}$, . . . , $S_{AGm}$, and $S_{ABm}$ between t3 and t4. More specifically, the time when the first switch S1 is turned off is delayed proportional to the number of the display cells to be turned on and the number of the display cells to be turned on is proportional to the capacitance of the PDP 1 at the unit scan time $T_S$. In other words, a time when the collected charges are applied to the display cells varies proportional to the number of the display cells to be turned on and the number of the display cells to be turned on is proportional to the capacitance of the PDP 1 at the unit scan time $T_S$.

The above steps are repeatedly performed periodically and consecutively while scanning is periodically and sequentially performed on each of the X- and Y-electrode line pairs.

As described above, in the discharge display apparatus and the method of driving the same according to the present invention, the operational timing of a power recovery circuit varies in response to display data signals applied to address electrode lines. As a result, the operational timing of the power recovery circuit becomes proper for a variable capacitance of a discharge display panel so that the waveform of an addressing voltage is not distorted and consumed power decreases.

The present invention can be realized as computer-executable instructions in computer-readable media. The computer-readable media includes all possible kinds of media in which computer-readable data is stored or included or can include any type of data that can be read by a computer or a processing unit. The computer-readable media include for example and not limited to storing media, such as magnetic storing media (e.g., ROMs, floppy disks, hard disk, and the like), optical reading media (e.g., CD-ROMs (compact disc-read-only memory), DVDs (digital versatile discs), re-writable versions of the optical discs, and the like), hybrid magnetic optical disks, organic disks, system memory (read-only memory, random access memory), non-volatile memory such as flash memory or any other volatile or non-volatile memory, other semiconductor media, electronic media, electromagnetic media, infrared, and other communication media such as carrier waves (e.g., transmission via the Internet or another computer). Communication media generally embodies computer-readable instructions, data structures, program modules or other data in a modulated signal such as the carrier waves or other transportable mechanism including any information delivery media. Computer-readable media such as communication media may include wireless media such as radio frequency, infrared microwaves, and wired media such as a wired network. Also, the computer-readable media can store and execute computer-readable codes that are distributed in computers connected via a network. The computer readable medium also includes cooperating or interconnected computer readable media that are in the processing system or are distributed among multiple processing systems that may be local or remote to the processing system. The present invention can include the computer-readable medium having stored thereon a data structure including a plurality of fields containing data representing the techniques of the present invention.

Figure 8:
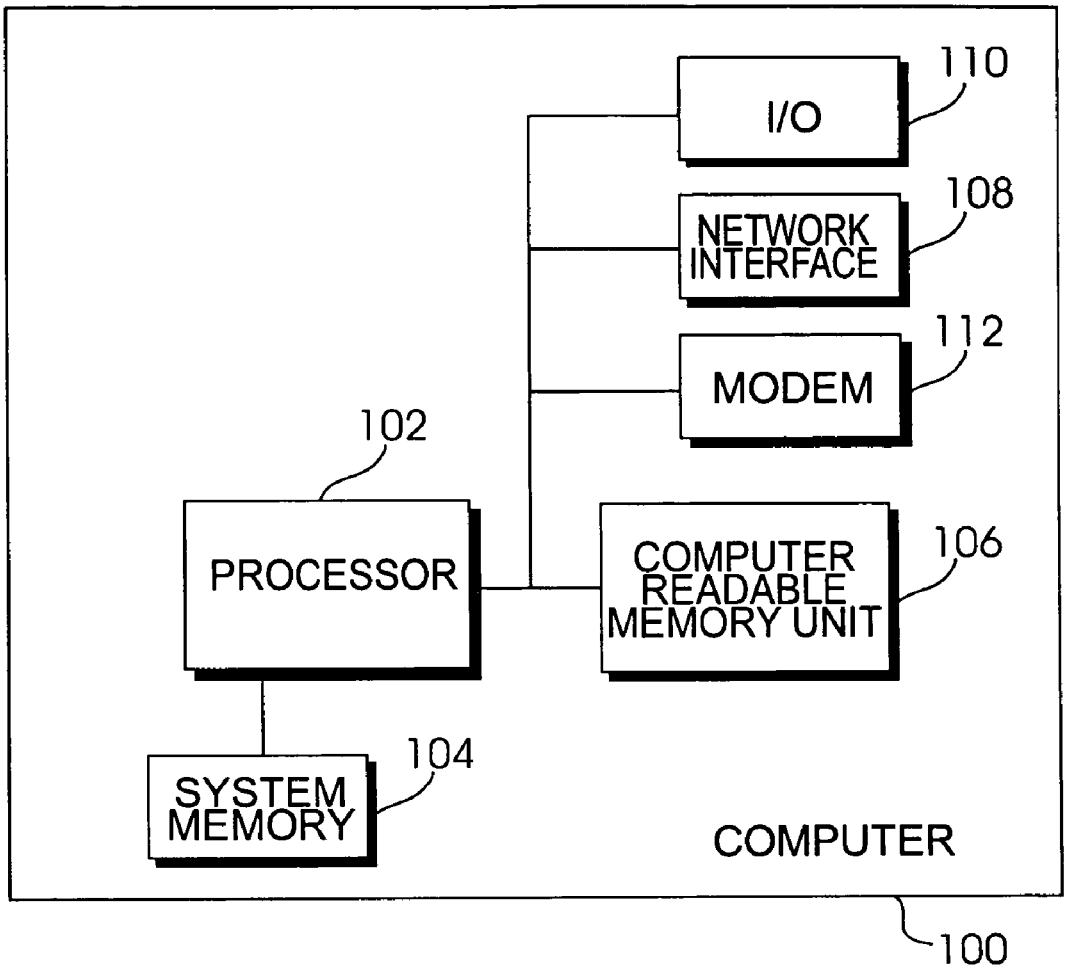
FIG. 8 shows an example of a computer including a computer-readable medium having computer-executable instructions for performing a technique of the present invention.

An example of a computer, but not limited to this example of the computer, that can read computer readable media that includes computer-executable instructions of the present invention is shown in FIG. 8. The computer 100 includes a processor 102 that controls the computer 100. The processor 102 uses the system memory 104 and a computer readable memory device 106 that includes certain computer readable recording media. A system bus connects the processor 102 to a network interface 108, modem 112 or other interface that accommodates a connection to another computer or network such as the Internet. The system bus may also include an input and output interface 110 that accommodates connection to a variety of other devices.

While the present invention has been particularly shown and described with reference to exemplary embodiment thereof, it will be understood by those skilled in the art that various changes in form and details maybe made therein without departing from the spirit and scope of the invention as defined by the following claims and equivalents thereof.

What is claimed is:

1. A discharge display apparatus comprising:

a discharge display panel;

a controller; and an address driver apparatus applying display data signals to address electrode lines of said discharge display panel, said address driver apparatus comprising:

an address driver; and a power recovery circuit for said address driver, with said controller being adapted to control the operational timing of said power recovery circuit to be varied in response to the display data signals applied to the address electrode lines, wherein said controller is adapted to control the operational timing of the power recovery circuit to be varied according to a capacitance of said discharge display panel generated in response to the display data signals, wherein said controller is adapted to the operational timing of said power recovery circuit to be varied depending on the number of display cells to be turned on.

2. A discharge display apparatus comprising:

a discharge display panel;

a controller; and an address driver apparatus applying display data signals to address electrode lines of said discharge display panel, said address driver apparatus comprising:

an address driver; and a power recovery circuit for said address driver, with said controller being adapted to control the operational timing of said power recovery circuit to be varied in response to the display data signals applied to the address electrode lines, wherein said power recovery circuit collects charges remaining in the display cells at a time when applying of the display data signals is complete and applies the collected charges to the display cells at a time when applying of the display data signals starts.

3. The discharge display apparatus of claim 2, wherein a time taken for collecting the charges remaining in the display cells is proportional to a capacitance of said discharge display panel in response to the display data signals.

4. The discharge display apparatus of claim 3, wherein the time taken for collecting the charges remaining in the display cells is proportional to the number of display cells to be turned on.

5. The discharge display apparatus of claim 2, wherein a time taken for applying the collected charges to the display cells is proportional to a capacitance of said discharge display panel in response to the display data signals.

6. The discharge display apparatus of claim 5, wherein the time taken for applying the collected charges to the display cells is proportional to the number of display cells to be turned on.

7. The discharge display apparatus of claim 2, wherein the time taken for collecting the charges remaining in the display cells and the time taken for applying the collected charges to the display cells are proportional to a capacitance of the discharge display panel in response to the display data signals.

8. The discharge display apparatus of claim 7, wherein the time taken for collecting the charges remaining in the display cells and the time taken for applying the collected charges to the display cells are proportional to the number of display cells to be turned on.

9. A method of driving a discharge display apparatus, said discharge display apparatus comprising a discharge display panel, a controller and an address driver apparatus, said method comprising:

applying, by said address driver apparatus display data signals to address electrode lines of the discharge display panel and including an address driver and a power recovery circuit for the address driver; and controlling, by said controller, an operational timing of said power recovery circuit to be varied in response to the display data signals applied to the address electrode lines, wherein said controller is adapted to control the operational timing of the power recovery circuit to be varied according to a capacitance of said discharge display panel in response to the display data signals, wherein said controller is adapted to control the operational timing of said power recovery circuit to be varied depending on the number of display cells to be turned on.

10. A method of driving a discharge display apparatus, said discharge display apparatus comprising a discharge display panel, a controller and an address driver apparatus, said method comprising:

applying, by said address driver apparatus display data signals to address electrode lines of the discharge display panel and including an address driver and a power recovery circuit for the address driver;

controlling, by said controller, an operational timing of said power recovery circuit to be varied in response to the display data signals applied to the address electrode lines; and collecting, by said power recovery circuit, charges remaining in the display cells at a time when applying of the display data signals is complete and applying the collected charges to the display cells at a time when applying of the display data signals starts.

11. The method of claim 10, wherein a time taken for collecting the charges remaining in the display cells is proportional to a capacitance of said discharge display panel in response to the display data signals.

12. The method of claim 11, wherein the time taken for collecting the charges remaining in the display cells is proportional to the number of display cells to be turned on.

13. The method of claim 10, wherein a time taken for applying the collected charges to the display cells is proportional to a capacitance of said discharge display panel in response to the display data signals.

14. The method of claim 13, wherein the time taken for applying the collected charges to the display cells is proportional to the number of display cells to be turned on.

* * * * *